US012179894B2

(12) United States Patent
Redburn

(10) Patent No.: US 12,179,894 B2
(45) Date of Patent: Dec. 31, 2024

(54) DOCKING APPARATUS AND METHOD

(71) Applicant: Keith Redburn, Bay City, MI (US)

(72) Inventor: Keith Redburn, Bay City, MI (US)

( * ) Notice: Subject to any disclaimer, the term of this patent is extended or adjusted under 35 U.S.C. 154(b) by 347 days.

(21) Appl. No.: 17/543,266

(22) Filed: Dec. 6, 2021

(65) Prior Publication Data

US 2022/0177085 A1 Jun. 9, 2022

Related U.S. Application Data

(60) Provisional application No. 63/121,943, filed on Dec. 6, 2020.

(51) Int. Cl.

| | |
|---|---|
| ***B63B 59/02*** | (2006.01) |
| ***B63B 1/12*** | (2006.01) |
| ***B63B 35/38*** | (2006.01) |

(52) U.S. Cl.

CPC ..... *B63B 59/02* (2013.01); *B63B 1/121* (2013.01); *B63B 35/38* (2013.01)

(58) Field of Classification Search

CPC ..... B63B 59/02; B63B 1/121; B63B 35/38
See application file for complete search history.

(56) References Cited

U.S. PATENT DOCUMENTS

| | | | | |
|---|---|---|---|---|
| 1,145,749 | A * | 7/1915 | Claud | B63B 59/02 114/220 |
| 2,847,964 | A * | 8/1958 | Skinas | B63B 43/18 293/26 |
| 3,744,445 | A * | 7/1973 | Malenka | B63B 59/02 114/219 |
| 6,695,336 | B1 * | 2/2004 | Grabenstetter | B60P 3/1033 280/414.2 |
| 11,001,352 | B1 * | 5/2021 | Nassim | E02B 15/104 |
| 11,459,064 | B1 * | 10/2022 | Simard | B63B 3/68 |
| 2019/0127033 | A1 * | 5/2019 | Doig | B63B 35/34 |

FOREIGN PATENT DOCUMENTS

| | | | | |
|---|---|---|---|---|
| IT | MI20130321 | | 9/2014 | |
| WO | WO-2015143488 | A1 * | 10/2015 | B63B 21/00 |

* cited by examiner

*Primary Examiner* — S. Joseph Morano
*Assistant Examiner* — Jovon E Hayes
(74) *Attorney, Agent, or Firm* — Poznak Dyer Kanar Schefsky Thompson PLC; Robert C. Corbett

(57) ABSTRACT

A docking system for a boat includes spring-loaded bumpers that protrude from the bow of the boat, thereby enabling a boat operator to dock the boat against a vertical structure such as a seawall. Anchors are mounted with respect to the seawall to which ropes may be tied to secure the boat and maintain contact between the bumpers and the seawall. Anchors may be supported above the water level by floats, which automatically adjust the height of the anchors in response to changes in the water level.

11 Claims, 6 Drawing Sheets

DOCKING APPARATUS AND METHOD

CROSS-REFERENCE TO RELATED APPLICATION

This application claims the benefit of U.S. Provisional Patent Application No. 63/121,943, filed Dec. 6, 2020, and which is hereby incorporated by reference in its entirety.

TECHNICAL FIELD

This disclosure relates to systems and methods for docking boats.

BACKGROUND OF THE INVENTION

Docking a recreational boat, such as a pontoon boat, typically requires the installation of a dock. Docks are often substantial structures, which involve a significant cost to install.

SUMMARY

According to a first aspect of the invention, a bumper system includes a receiver mountable to a boat or other watercraft. In one embodiment the receiver is a tube. The bumper system further includes a spring-loaded bumper that is releasably engageable with the receiver to operatively connect the spring-loaded bumper to the boat such that the spring-loaded bumper protrudes from the boat.

The bumper system enables the docking of a boat at a vertical structure such as a sea wall. More specifically, the bumper system enables the operator of the boat to maneuver the boat against the seawall by absorbing the kinetic energy of the boat. More specifically, the operator of the boat causes the boat to move such that the spring-loaded bumper contacts the seawall, and the spring absorbs the kinetic energy of the boat, thereby protecting the boat and the seawall from damage. The ability of the boat to dock at a seawall increases the number of locations available for docking and avoids the installation of expensive prior art docks.

In one embodiment, the bumper extends forward of the bow, enabling an operator of the boat to have the bumper engage a seawall by propelling the boat in the forward direction, thereby facilitating the docking procedure compared to attempting to dock along a side of the boat. The receiver mounted under the deck ensures that the bumper, or any other accessory that may be engaged with the receiver, does not occupy valuable and limited space in the passenger area of the boat According to a second aspect of the invention, a docking system for use with a boat having the bumper is provided. The docking system includes a seawall with an anchor assembly mounted thereto. The anchor assembly is mounted with respect to the seawall and includes an anchor, or cleat, to which a rope may be tied to secure the boat with respect to the seawall. Accordingly, when used with a boat having the bumper assembly, the docking system enables rapid and easy docking of the boat. Further, the docking system is lower cost than a dock, and increases the number of potential docking locations on a body of water.

In one embodiment, the anchor assembly is configured for rapid and easy attachment to a seawall. The anchor assembly includes an anchor portion configured for engagement with a rope such that a boat can be tied to the anchor. The anchor portion is operatively connected to a clamp that is engageable with a beam at the top of the seawall. The anchor assembly enables rapid attachment to a seawall above the waterline. The anchor assembly, when used in connection with the bumper system, provides boat operators with a rapid, low-cost means of making a seawall a docking location.

In another embodiment of the anchor assembly, an anchor member to which a rope may be tied is supported above the surface of the water by a float, i.e., a member exhibiting buoyancy in water. The float is in contact with the body of water and the float and the anchor member are slidingly mounted to a substantially vertical support adjacent to the seawall. Accordingly, the anchor member moves in response to changes in the water level, which ensures that the rope interconnecting the boat to the anchor member can be kept taut regardless of changes to the water level.

According to a third aspect of the invention, a method of using the docking system includes causing the boat having the bumper system installed thereon to approach the seawall such that the spring-loaded bumper contacts the seawall or a member mounted to the seawall, thereby causing the bumper system to absorb at least a portion of the boat's kinetic energy. The method may also include securing the boat relative to the seawall by tying a rope connected to the boat to the anchor member.

The above features and advantages and other features and advantages of the present disclosure are readily apparent from the following detailed description of the best modes for carrying out the disclosure when taken in connection with the accompanying drawings.

DESCRIPTION OF THE PREFERRED EMBODIMENTS

Figure 1:
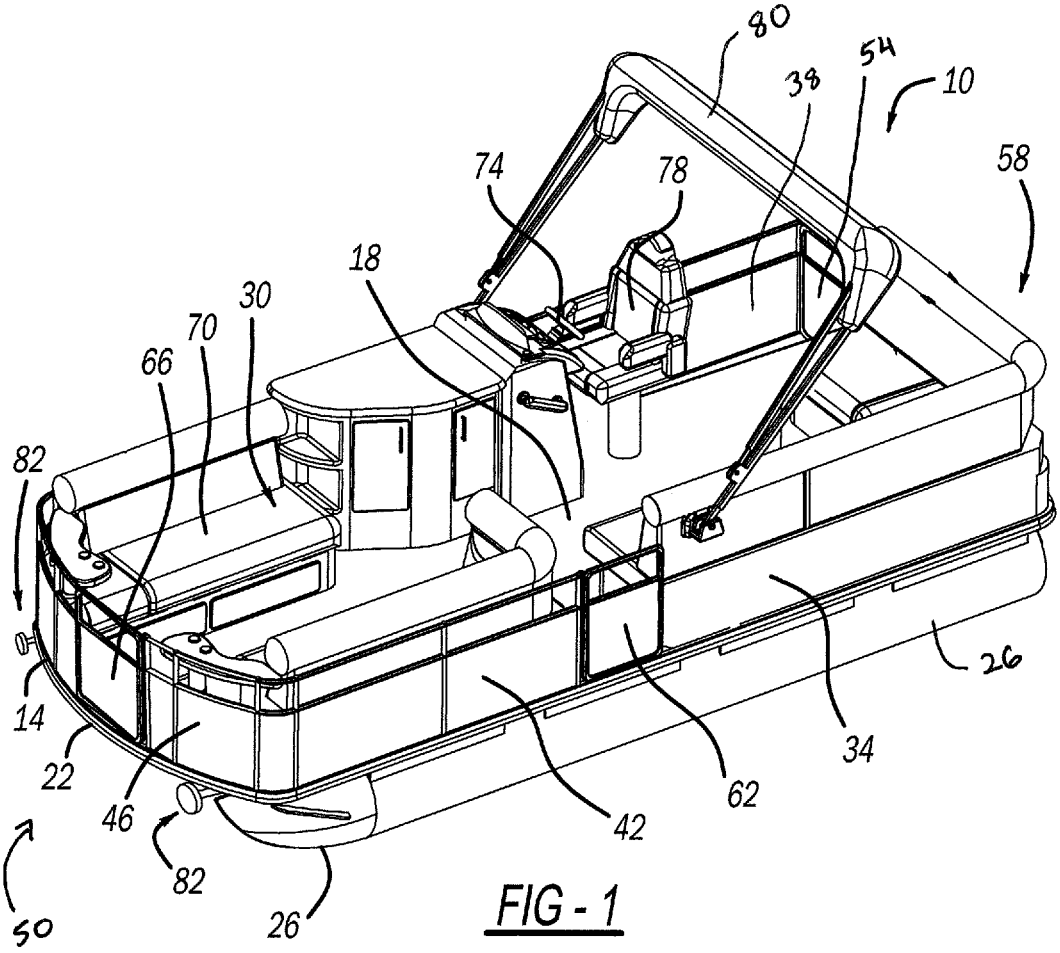
FIG. 1 is a schematic, perspective view of a pontoon boat.

Referring to the Figures, wherein like reference numbers refer to like components throughout, a boat docking apparatus and method are schematically depicted. Referring specifically to FIG. 1, a pontoon boat 10 includes a platform or deck 14 having an upper surface 18 and a lower surface 22. The deck 14 is mounted with respect to pontoons 26, as understood by those skilled in the art. The upper surface 18 defines the floor of a passenger area 30. The pontoon boat 10 includes fencing 34 mounted to the deck 14 and extending upward from the upper surface 18.

The fencing 34 includes side portions 38, 42 that extend fore and aft or longitudinally along respective sides of the upper surface 18. The fencing 34 also includes a forward portion 46 at or adjacent to the bow 50. The forward portion 46 is generally perpendicular to, and interconnects, the side portions 38, 42. A rear portion 54 of the fencing 34 is at or adjacent to the stern 58. The rear portion 54 is generally perpendicular to, and interconnects, the side portions 38, 42. In the embodiment depicted, one of the side portions 38 includes a gate 62. Similarly, the forward portion 46 includes a gate 66.

The fencing 34 surrounds the passenger area 30, which may include seating assemblies 70, a steering wheel 74, a captain's chair 78, etc. The pontoon boat 10 may include a selectively retractable awning or canopy 80 as understood by those skilled in the art. The boat 10 has two bumper systems 82 operatively connected to the deck 14.

Figure 2:
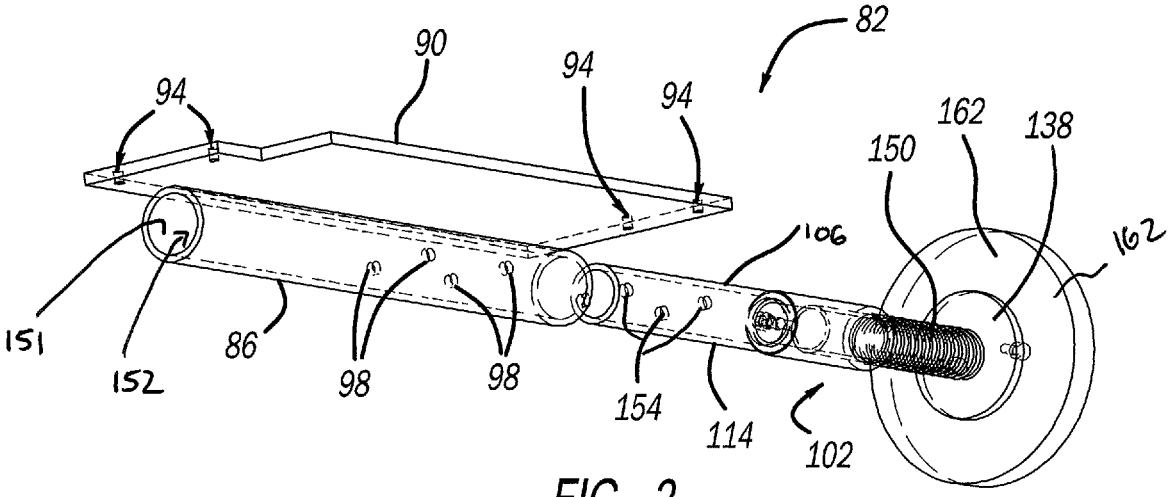
FIG. 2 is a schematic, perspective view of a bumper system in accordance with the claimed invention including a receiver and a bumper assembly having a bumper.
Figure 3:
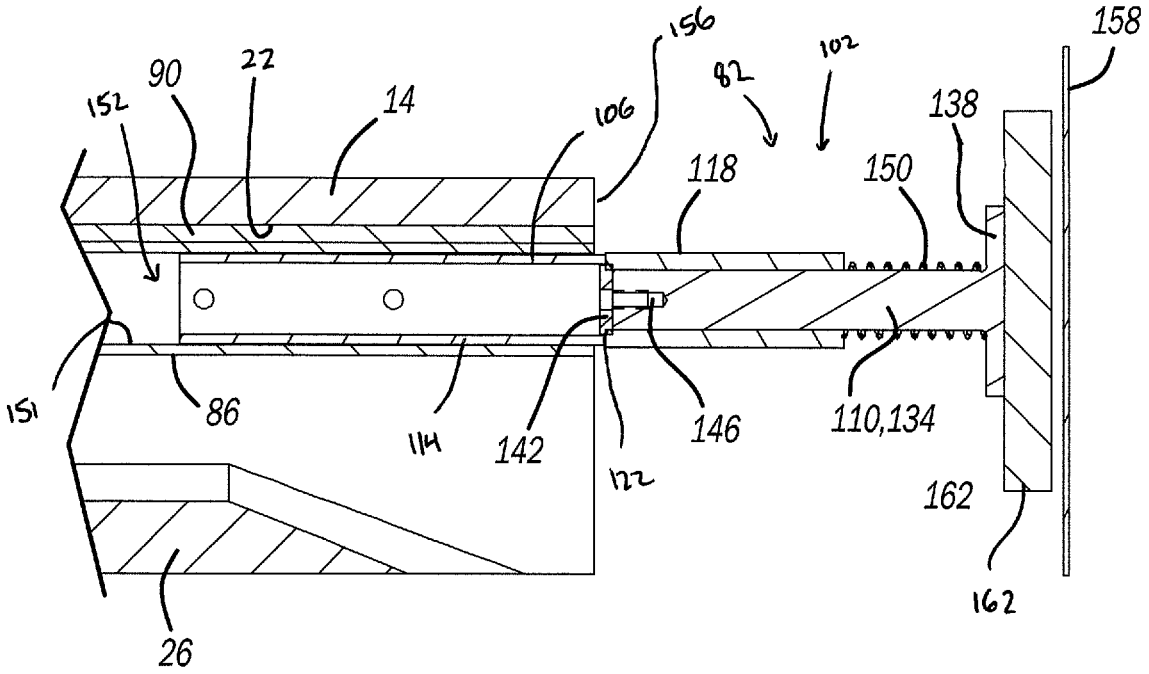
FIG. 3 is a schematic, sectional, side view of the bumper system of FIG. 2 attached to the pontoon boat of FIG. 1 with the bumper member in an extended position.
Figure 4:
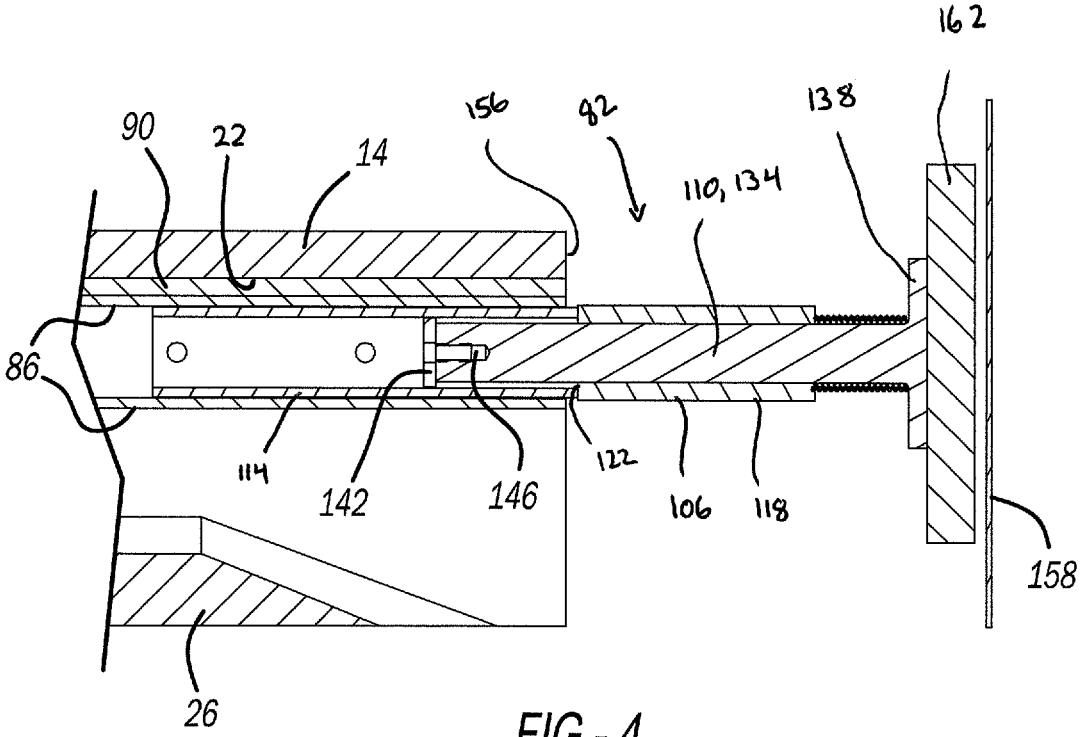
FIG. 4 is a schematic, sectional, side view of the bumper system of FIG. 2 attached to the pontoon boat of FIG. 1 with the bumper member in a retracted position.
Figure 5:
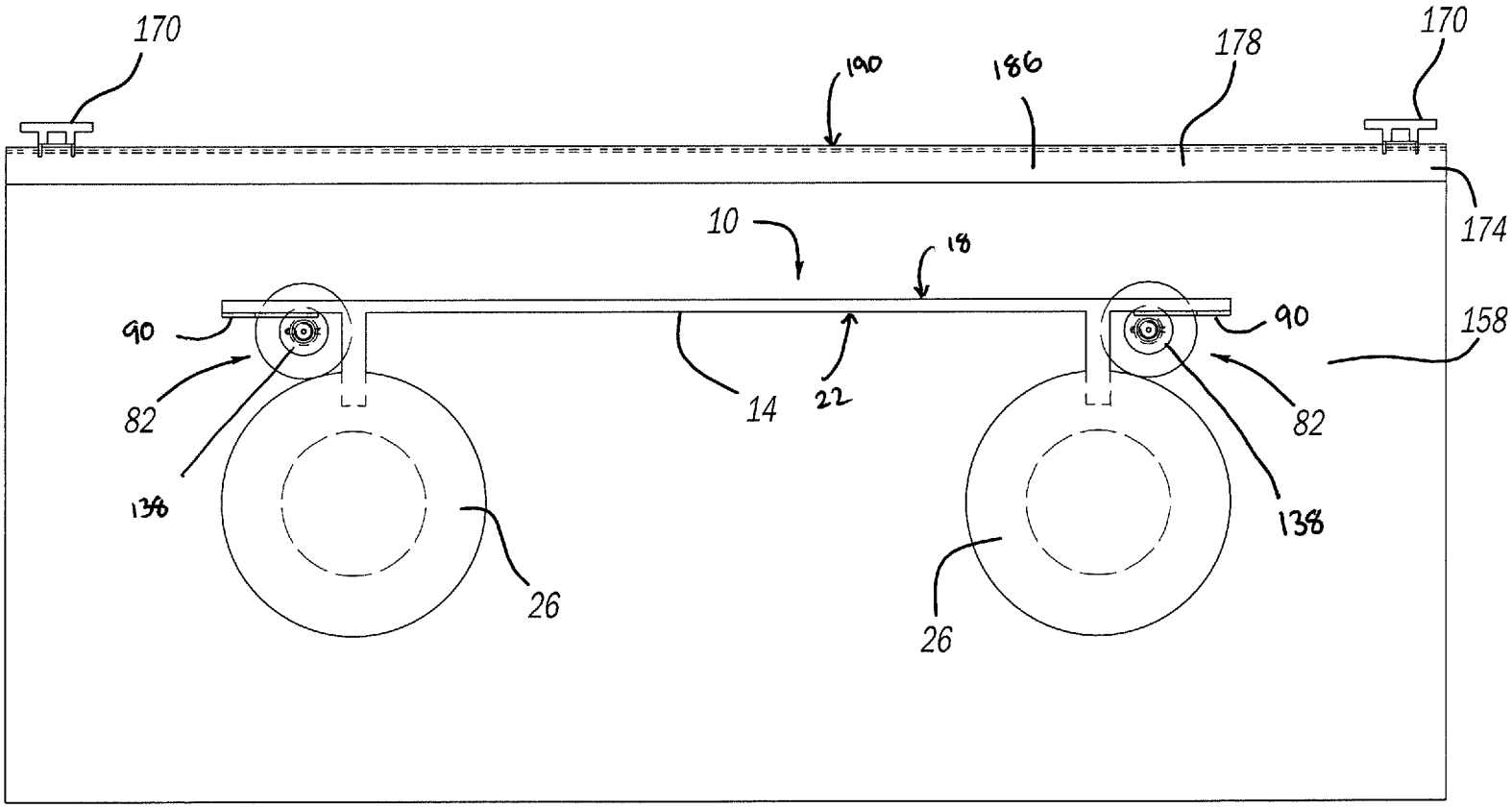
FIG. 5 is a schematic, front view of a seawall engaging the bumper assembly.

FIGS. 2-4 schematically depict one of the bumper systems 82. It should be noted that, in the embodiment depicted, the two bumper systems 82 are substantially identical to one another. Referring to FIGS. 2-4, the bumper system 82 includes a receiver 86. The receiver 86 is tubular; in the embodiment depicted, the receiver 86 is cylindrical, though other tubular receivers may be employed within the scope of the claimed invention. For example, the receiver may have a square or rectangular cross-sectional shape. The bumper system 82 in the embodiment depicted also includes a plate 90 to which the receiver 86 is mounted, such as by welding. The plate 90 defines a plurality of holes 94. The plate 90 is mountable to the underside, i.e. the lower surface 22, of the deck 14 with fasteners (not shown) extending through the holes 94, and thus the receiver 86 is mountable to the boat 10 underneath the deck 14 via the plate 90. The receiver 86 defines a plurality of holes 98.

The bumper system 82 also includes a bumper assembly 102. The bumper assembly 102 includes a housing 106 and a bumper member 110 that is movably connected to the housing 106. The housing 106 is tubular, and, in the embodiment depicted, is cylindrical. The housing 106 includes a first segment 114 and a second segment 118. The inner diameter of the second segment 118 is smaller than the inner diameter of the first segment 114, and thus a lip 122 is formed at the junction of the first and second segments 114, 118. The lip 122 extends radially inward into the bore defined by the housing 106 from the inner surface of the first segment 114.

In the embodiment depicted, the first and second segments 114, 118 are separate pieces operatively connected to one another so that their respective centerlines are coextensive, though the first and second segments 114, 118 may be formed from a single piece of material within the scope of the claimed invention. The second segment 118 may include a bushing (not shown).

The bumper member 110 includes a cylindrical portion 134 and an enlarged, flat end 138. The outer diameter of the cylindrical portion 134 is slightly less than the inner diameter of the second segment 118 of the housing 106. The cylindrical portion 134 extends into the bore of housing 106, and the interaction between the cylindrical portion 134 and the inner surface of segment 118 permits movement of the bumper member 110 relative to the housing 106 but limits movement of the bumper member 110 relative to the housing 106 to substantially linear translation.

The enlarged, flat end 138 is wider than the inner diameter of the housing 106, and thus the end 138 remains outside the housing 106. A capture plate 142 is mounted to the end of the cylindrical portion 134 by a bolt 146. The plate 142 is disposed within the first segment 114 of the housing 106. The width of plate 142 is larger than the inner diameter of the second segment 118, and thus physical part interference between the plate 142 and the lip 122 limits forward movement of the bumper member 110 relative to the housing. Thus, the bumper member 110 is slidable relative to the housing 106 between a fully extended position, as shown in FIG. 3, in which the end 138 is at its maximum extension from the housing 106 and the plate 142 contacts the lip 122, and a fully retracted position, as shown in FIG. 4. When the bumper assembly 82 is mounted to the boat 10 as shown in FIG. 1, the bumper member 110 slides rearward when moving from the extended position to the retracted position.

The bumper assembly 102 also includes a spring 150 that biases the bumper member 110 in its fully extended position, as shown in FIG. 3. More specifically, in the embodiment depicted, the spring 150 is a coil spring through which the cylindrical portion 134 extends. The spring 134 contacts the end of the housing 106 and the end 138, urging them apart from one another.

The first segment 114 of the housing 106 has an outer diameter that is less than the inner diameter of the receiver 86, and thus the first segment 114 of the housing 106 is insertable into the receiver 86. More specifically, the inner surface 151 of the receiver 86 defines an interior space 152; the first segment 114 is fittable within the interior space 152 of the receiver 86. When the housing 106 is at least partially within the interior space 152, holes 154 in the first segment of the housing 106 are alignable with the holes 98 in the receiver. The housing 106 is substantially rigidly connectable to the receiver 86 by extending fasteners through holes 98 and holes 154, as understood by those skilled in the art.

Referring to FIG. 3, the bumper system 82 is shown installed on the boat 10. More specifically, the plate 90 is attached to the underside of the deck 14 such that the receiver 86 is disposed beneath the deck 14 adjacent the bow 50. The bumper assembly 102 is mounted to the receiver 86 such that the end 138 extends forward of the bow 50 and the forward edge 156 of the deck 14. The boat 10 preferably includes two bumper systems 82, each being installed to the underside of the deck 14 adjacent a respective one of the pontoons 26 and each protruding forward of the bow 50.

Referring to FIGS. 3-5 and 8, a method of using the bumper systems 82 includes piloting the boat 10 in water and causing the boat 10 to approach a seawall 158 such that the ends 138 of the bumper members 110 contact hard plastic pads 162 mounted to the seawall 158. The kinetic energy of the boat 10 moving forward is transferred to the bumper members 110 via a reaction force exerted by the pads 162, which causes the bumper members 110 to move relative to the housing 106 from their fully extended positions, as shown in FIG. 3, toward their retracted positions, as shown in FIG. 4; movement from the extended positions toward the retracted positions causes springs 150 to elastically compress and thereby absorb and store the kinetic energy of the boat 10 as potential energy, as shown in FIG. 4.

Figure 7:
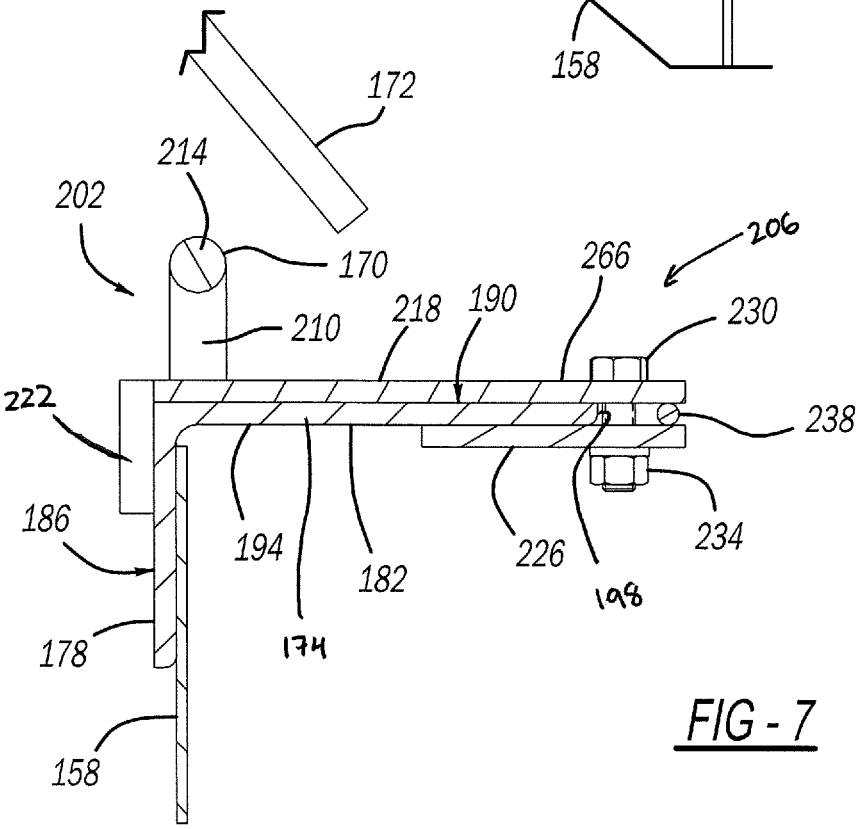
FIG. 7 is a schematic, sectional, side view of a portion of the seawall and the anchor attached thereto.
Figure 8:
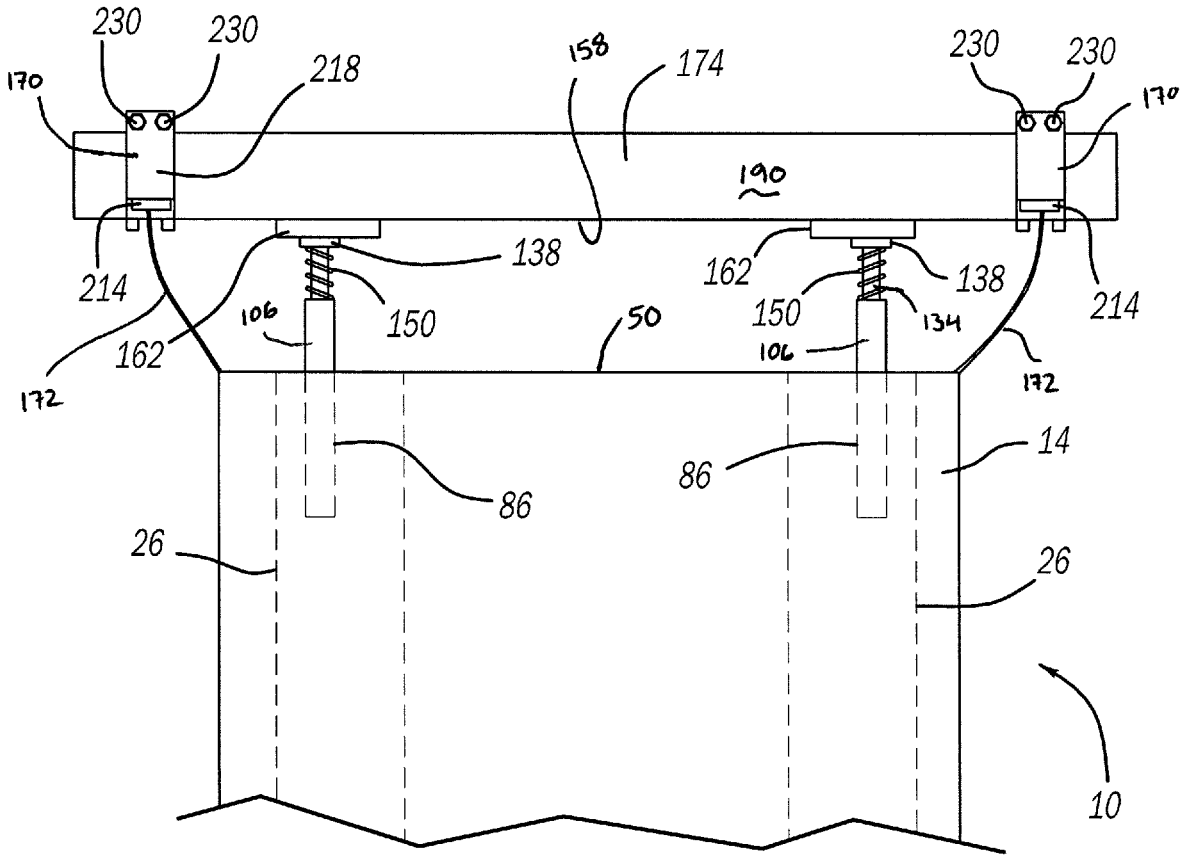
FIG. 8 is a schematic, top view of the boat with the bumpers engaged with the seawall and the boat ties to the anchors of FIGS. 6 and 7.
Figure 9:
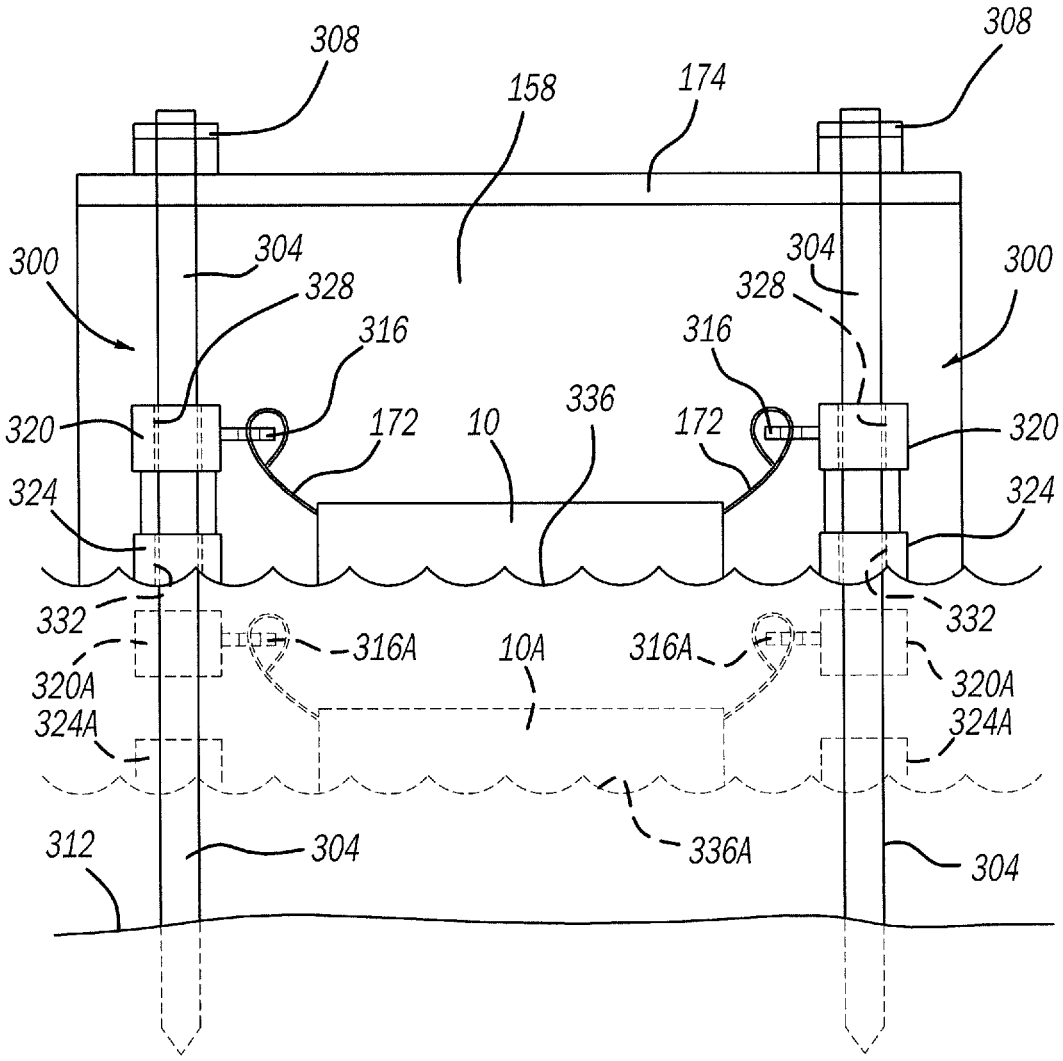
FIG. 9 is a schematic, front view of the seawall with the bumpers of the boat engaged with the seawall and the boat tied to alternative anchors.

The method further includes tying or otherwise securing the boat 10 with respect to the sea wall 158 via anchors, such as the anchors shown at 170 in FIGS. 5-8 or the anchor assemblies shown at 300 in FIG. 9. In the embodiment depicted, the seawall 158 includes two rope anchors 170, and the step of securing the boat 10 with respect to the seawall 158 includes tying the boat 10 to each of the anchors 170 via a respective rope 172.

Figure 6:
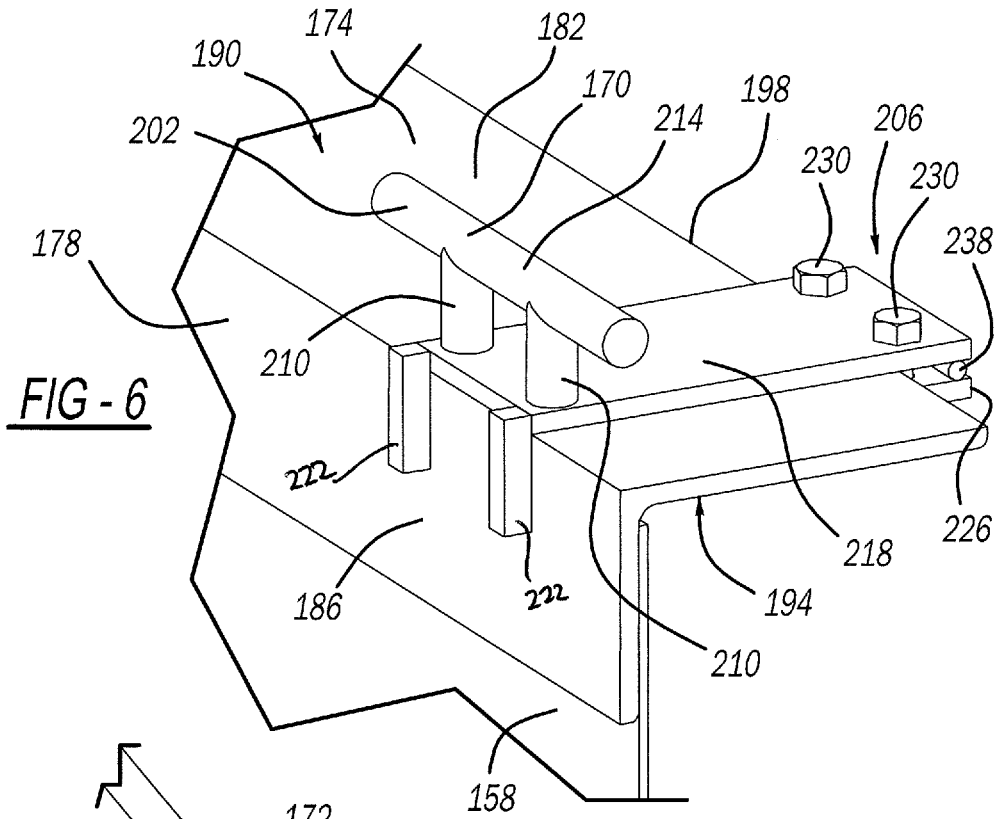
FIG. 6 is a schematic, perspective view of a portion of the seawall and an anchor attached thereto.

FIGS. 6 and 7 schematically depict one of the anchors 170. Referring specifically to FIGS. 7 and 8, the anchors 170 are configured for easy attachment to the seawall 158. The seawall 158 includes a top member 174 that is an angle beam having an L-shaped cross-section. More specifically, member 174 includes a first portion 178 and a second portion 182. First portion 178 and second portion 182 are connected to one another at a right angle.

First portion 178 defines a first generally planar surface 186. Surface 186 is substantially vertically oriented (i.e., is coplanar about a vertical plane) and faces the direction of the body of water. Second portion 182 defines a second generally planar surface 190 that is substantially horizontally oriented (i.e., is coplanar about a horizontal plane) and that faces upward. The second portion 182 also defines a third generally planar surface 194 that is on the opposite side of the second portion 182 from the second planar surface 190. The third planar surface 194 is substantially parallel to the second planar surface 190. The second portion 182 also defines an edge 198.

The anchor 170 includes an anchor portion 202 and a clamp portion 206. The anchor portion 202 is configured for engaging the rope 172 to secure the boat with respect to the seawall 158. In the embodiment depicted, the anchor portion 202 includes two posts 210 that are connected to, and extend from, the clamp portion 206, and that extend vertically upward when in use as shown. The anchor portion 202 in the embodiment depicted further includes a portion 214 that interconnects the two posts 210 and that extends horizontally when in use as shown.

The clamp portion 206 is configured to contact the first generally planar surface 186, the second generally planar surface 190, and the third generally planar surface 194 to secure the anchor portion 202 to the seawall. More specifically, in the embodiment depicted, the clamp portion 206 includes a first plate 218 that has a length greater than the width of the second generally planar surface 190. The anchor 170 is positioned such that the plate 218 traverses the width of the surface 190. Two posts 222 are connected to the plate 218 and extend downward and contact the first generally planar surface 186. The first plate 218 defines two holes in the portion of the plate that overhangs beyond the edge 198. The plate 218 and the posts 222 together form a member that contacts surfaces 186 and 190.

The clamp portion 206 also includes a second plate 226 that, in use as shown, contacts the third generally planar surface 194 and that extends past the edge 198. The second plate 226 also defines two holes in the portion that extends past edge 198. The second plate 226 is secured to the first plate 218 by threaded fasteners 230 that extend through the holes in the first plate 218 and the second plate 226 and are secured by nuts 234 as shown.

The portions of the plates 218, 226 that extend beyond and overhang past the edge 198 do not have any portion of the member 174 therebetween. To provide stability, a spacer rod 238 is welded to one of the two plates 218, 226. In the embodiment depicted, the spacer rod 238 is welded to the second plate 226 such that it is between the first and second plates 218, 226 in the overhang region. The thickness of the rod 238 is approximately equal to the thickness of the second portion 182 of the member 174.

FIG. 9 schematically depicts an alternative anchor assembly configuration for use with the seawall 158 and the boat 10 with bumper assemblies 82. Referring to FIG. 9, two anchor assemblies 300 are operatively connected to the seawall 158. Each anchor assembly includes a vertical support 304, which, in the embodiment depicted, is a cylindrical shaft. The supports 304 extend from above the seawall 158, where they are supported by brackets 308 connected to the seawall 158, to the bed 312 of the body of water. The shafts 304 extend into the bed 312 for further support.

Each anchor assembly 300 includes a respective anchor 316 at which a rope 172 may be tied tautly to secure the boat 10 and maintain contact between the bumper members (not shown in FIG. 9) and the seawall 158. In the embodiment depicted, the anchors are members that define holes through which the rope may be passed, but any anchor configuration suitable for tying a rope thereto may be employed within the scope of the claimed invention.

Each anchor 316 is operatively connected to a respective support 304 via a respective collar 320. Each collar 320 defines a respective hole 328 through which a respective support 304 extends so that the collar 320 is slidable along the length of the support 304. Each anchor assembly 300 also includes a respective float 324, i.e., a member that exhibits significant buoyancy in water. The floats 324 are in contact with the body of water and float on or adjacent to the surface of the water 336. Each float 324 is connected to a respective one of the collars 320 and, correspondingly, to a respective one of the anchors 316, such that each float 324 supports a respective collar and anchor above the surface of the water 336.

In the embodiment depicted, each float 324 defines a respective hole 332 through which a respective one of the supports 304 extends so that the float 324 is slidable vertically along the length of the support 304, while the interaction with the support 304 prevents substantially horizontal movement of the floats 324.

The vertical position of the anchors 316 is therefore dependent on the water level, i.e., the level of the surface of the water 336. More specifically, as the water level changes, the position of the floats 324 change, which, due to the interconnection between the floats 324 and the anchors 316, causes the position of the anchors 316 to change. For example, if an operator docks the boat 10 with the bumper members in contact with the seawall 158 and then ties ropes 172 from the boat 10 to the anchors 316 as shown, and then the water level decreases from the level shown at 336 to the level shown in phantom at 336A, then the boat 10 will move to the position shown in phantom at 10A. The floats 324 will also move to the positions shown in phantom at 324A and bring the collars and anchors to the positions shown at 320A and 316A, respectively.

This movement of the anchors 316 with water level ensures that the anchors 316 will be at an appropriate height for use when docking the boat 10, and will ensure that the ropes 172 can remain taut to secure the bumpers against the seawall 158 despite changes in the water level once the boat is docked.

While the best modes for carrying out the invention have been described in detail, those familiar with the art to which this invention relates will recognize various alternative designs and embodiments for practicing the invention within the scope of the appended claims.

The invention claimed is:

1. A boat comprising:

at least two pontoons;

a deck mounted above said at least two pontoons and having a lower surface;

a first receiver tube defining a first interior space, being mounted to the deck, and being positioned under the lower surface;

a second receiver tube defining a second interior space, being mounted to the deck, and being positioned under the lower surface;

a first bumper assembly having a first housing and a first bumper member movably mounted relative to the first housing;

a second bumper assembly having a second housing and a second bumper member movably mounted relative to the second housing;

said first housing being at least partially within the first interior space, and said first bumper member extending past an edge of the deck; and said second housing being at least partially within the second interior space, and said second bumper member extending past the edge of the deck.

2. The boat of claim 1, wherein the first housing defines a first bore;

wherein the second housing defines a second bore;

wherein the first bumper member is at least partially within the first bore such that the first bumper member is slidable relative to the first housing between an extended position and a retracted position; and wherein the second bumper member is at least partially within the second bore such that the second bumper member is slidable relative to the second housing between an extended position and a retracted position.

3. The boat of claim 2, wherein the first bumper assembly includes a first spring that biases the first bumper member toward its extended position; and wherein the second bumper assembly includes a second spring that biases the second bumper member toward its extended position.

4. The boat of claim 3, wherein said deck has a forward edge;

wherein the first interior space is open in the forward direction relative to the boat;

wherein the second interior space is open in the forward direction relative to the boat;

wherein the first and second bumper members are at least partially forward of the forward edge; and wherein the first and second bumper members are selectively slidable in the fore and aft directions relative to the boat.

5. A method comprising:

piloting a boat on a body of water, the boat having at least two pontoons, a deck mounted above said at least two pontoons and having a lower surface; first and second bumper members mounted to the boat such that the first and second bumper members extend forward of the bow of the boat;

propelling the boat forward to cause the first and second bumper members to contact a substantially vertical seawall;

tying a first rope to a first anchor that is operatively connected to the seawall, said first rope being connected to the boat; and tying a second rope to a second anchor that is operatively connected to the seawall.

6. The method of claim 5, wherein the seawall includes an angle beam having a first portion and a second portion;

wherein the first portion defines a substantially vertical surface;

wherein the second portion defines a first substantially horizontal surface and a second substantially horizontal surface that is substantially parallel to the first horizontal surface;

wherein the first anchor includes an anchor portion and a clamp portion;

wherein the clamp portion has a first member that contacts the substantially vertical surface and extends across the first substantially horizontal surface;

wherein the clamp portion has a second member that contacts the second substantially horizontal surface; and wherein the first member is mounted to the second member.

7. The method of claim 6, wherein the first member is mounted to the second member via threaded fasteners and bolts.

8. The method of claim 7, wherein one of the first and second members includes a spacer that contacts the other of the first and second members and is substantially the same thickness as the second portion of the angle beam.

9. The method of claim 7, wherein the second anchor is substantially identical to the first anchor.

10. The method of claim 5, wherein the first and second anchors are mounted to floats in contact with the body of water such that the vertical position of the first and second anchors varies with changes in the water level of the body of water.

11. The method of claim 10, wherein the floats include a first float and a second float;

wherein the first float is operatively connected to a first vertical support such that the first float is slidable along the first vertical support;

wherein the second float is operatively connected to a second vertical support such that the second float is slidable along the second vertical support.

* * * * *